United States Patent [19]

Claiborne et al.

[11] 4,108,189

[45] Aug. 22, 1978

[54] PAINT ROLLER CLEANER AND DRYER

[76] Inventors: Floyd H. Claiborne, 318 Louise Ave.; Roggie C. Ray, P.O. Box 366, both of Gallatin, Tenn. 37066

[21] Appl. No.: 766,034

[22] Filed: Feb. 7, 1977

[51] Int. Cl.[2] ..... B08B 3/02

[52] U.S. Cl. ..... 134/138; 134/149; 239/189

[58] Field of Search ..... 134/138–139, 134/149; 239/175–176, 189; 401/137, 208, 219–220

[56] References Cited

U.S. PATENT DOCUMENTS

| | | | |
|---|---|---|---|
| 2,094,161 | 9/1937 | Paddock | 239/289 X |
| 2,985,178 | 5/1961 | Christensen, Jr. | 134/149 |
| 3,133,548 | 5/1964 | Carr | 134/138 |
| 3,441,355 | 4/1969 | Brown | 401/208 X |
| 3,730,195 | 5/1973 | Kay | 134/138 |

*Primary Examiner*—Robert L. Bleutge
*Attorney, Agent, or Firm*—Clarence A. O'Brien; Harvey B. Jacobson

[57] ABSTRACT

A paint roller structure is provided comprising an elongated handle including first and second ends. A roller support frame is supported from one end of the handle and projects outwardly therefrom. An outer portion of the frame is laterally offset to one side of the handle and terminates outwardly in an end portion projecting toward and extending outwardly beyond the other side of the handle. The end portion of the frame has a paint roller journaled thereon and the handle includes water conduit structure extending therealong having a first end remote from the end of the handle from which the frame is supported adapted for communication with a source of water under pressure and a second end opening outwardly of the end of the handle from which the frame is supported and along a path extending along a chord of the roller. The second end of the water conduit structure tapers in a direction transverse to the axis of rotation of the roller and flares in a direction generally paralleling the roller axis whereby a fan-shaped stream of water may be discharged from the second end of the water conduit structure in a plane paralleling the axis of rotation of the roller and with the fan-shaped discharge of water contacting the roller throughout its entire length.

2 Claims, 4 Drawing Figures

FIG. 1
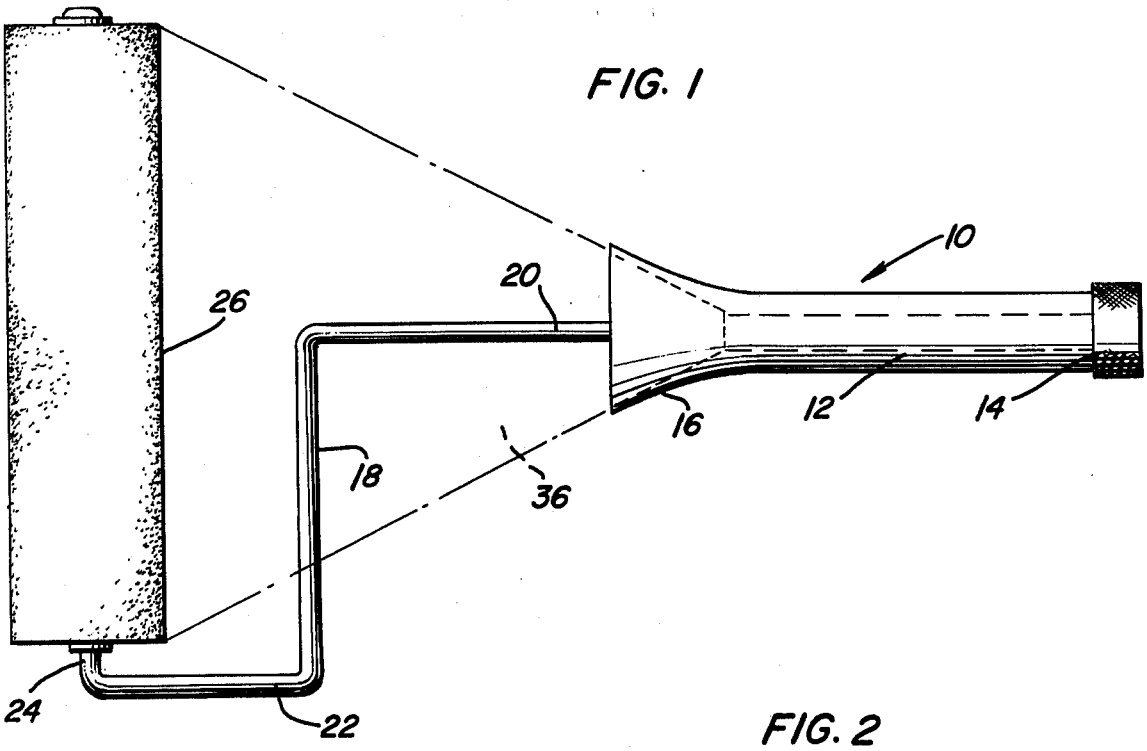
FIG. 2
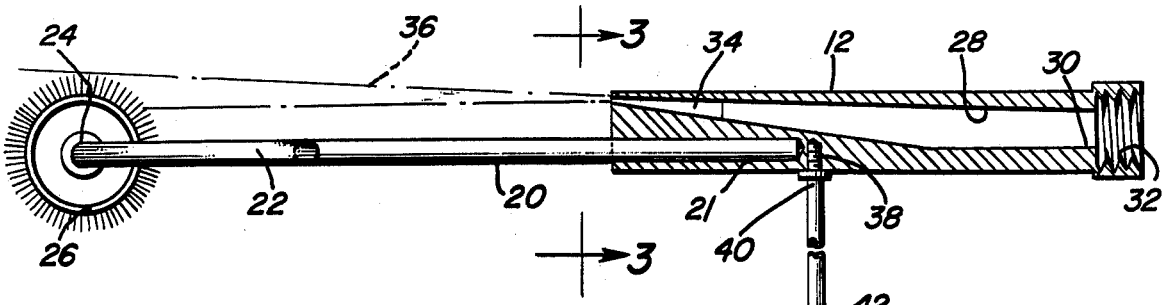
FIG. 3
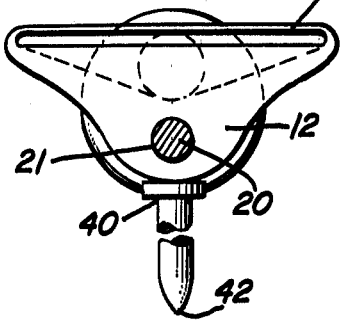
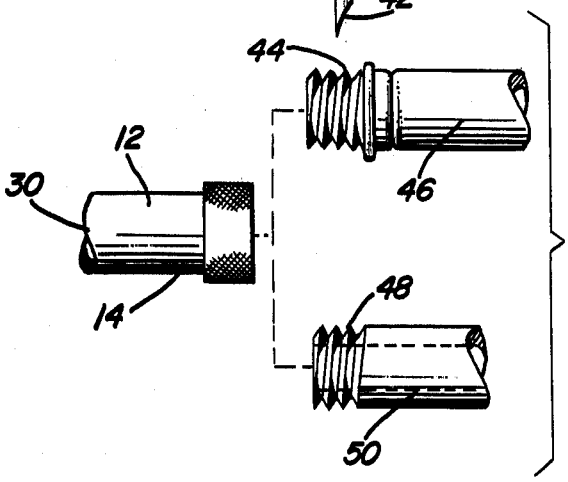
FIG. 4

PAINT ROLLER CLEANER AND DRYER

BACKGROUND OF THE INVENTION

Various forms of structures have been heretofore designed for the purpose of facilitating the cleaning of paint rollers and particularly paint rollers which are utilized in conjunction with those types of paint which may be thinned with water. These various devices have been constructed in different ways and are designed to enable a jet of water to be directed upon a paint roller in order to clean the nap of the roller substantially free of paint residue. Some of these previously known devices are also constructed in a manner whereby the jet of water directed upon the roller strikes the latter in a manner to impart rotation thereto. In this manner, as a jet of cleaning water is directed upon the roller and functions to dilute the paint residue on the roller and centrifugal force causes the water and the diluted paint residue to be spun from the roller. Accordingly, paint rollers may be rapidly cleaned substantially free of paint residue.

However, most of the previously known paint roller cleaners of this type employ various different forms of attachment structures and nozzles as well as shields which substantially increase the cost of production of the paint roller assembly. Accordingly, a need exists for an inexpensive form of paint roller structure including an additional feature whereby the roller portion thereof may be quickly cleaned of paint residue.

Various forms of paint roller cleaners, including some of the general structural and operational features of the instant invention are disclosed in U.S. Pat. Nos. 2,938,368, 3,133,548, 3,422,828, 3,730,195, and 3,755,840.

BRIEF DESCRIPTION OF THE INVENTION

The paint roller assembly of the instant invention is substantially conventional in design, except that the handle portion of the roller assembly includes a water conduit or passage extending longitudinally therethrough with the end of the passage adjacent the associated roller tapering in a direction transverse to the roller and flaring in a direction extending along the roller to thereby enable the passage to direct a fan-shaped discharge of water upon the roller when the end of the passage remote from the roller is communicated with a suitable source of water under pressure. Further, the outlet end of the water passage extending through the handle is positioned, relative to the roller, so as to direct the fan-shaped discharge of water therefrom toward the roller in a plane extending along a chord of the handle.

The main object of this invention is to provide a fast, simple and inexpensive method of cleaning and fluff drying the fibers or nap of a paint roller or roller cover.

A further object of this invention is to provide a paint roller assembly including integral structure whereby the assembly or structure, when operatively associated with a suitable source of water under pressure, may function to discharge a fan-shaped jet of water upon the roller in a plane extending along a short length chord of the roller.

Another object of this invention, in accordance with the immediately preceding object, is to provide a paint roller assembly including a removable ground spike whereby the roller assembly to be cleaned may be supported from an open portion of a residential yard, or the like, and operatively coupled to a domestic garden hose for supplying water to the paint roller assembly.

Yet another object of this invention is to provide a paint roller assembly including water cleaning structure therefor which does not materially alter the structure of a conventional paint roller assembly and requires only modifications to the handle portion thereof.

Still another object of this invention is to provide a paint roller assembly in accordance with the preceding objects and which will inherently be adapted for use in conjunction with an extension handle provided with one end equipped with male threads similar to those used on the male coupling end of a garden hose.

A final object of this invention to be specifically enumerated herein is to provide a paint roller assembly in accordance with the preceding objects and which will conform to conventional forms of manufacture, be of simple construction and easy to use so as to provide a device that will be economically feasible, long lasting and relatively trouble free in operation.

These together with other object and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a plan view of a substantially conventional paint roller assembly incorporating the water cleaning structure of the instant invention therein;

FIG. 2 is a side, elevational view of the assemblage illustrated in FIG. 1 and with the handle illustrated in longitudinal vertical section;

FIG. 3 is a transverse, vertical, sectional view taken substantially upon the plane indicated by section line 3—3 of FIG. 2; and FIG. 4 is a fragmentary, side elevational view of the face end of the handle of the paint roller assembly illustrating two form of water supply conduits which may be utilized in conjunction with the paint roller assembly and with the water supply conduits illustrated in exploded position.

DETAILED DESCRIPTION OF THE INVENTION

Referring now more specifically to the drawings, the numeral 10 generally designates a paint roller assembly constructed in accordance with the present invention.

The assembly 10 includes an elongated generally cylindrical handle 12 having first and second ends 14 and 16. A roller support frame 18 constructed of a single piece of rod has one end 20 thereof embedded in and supported from the handle as at 21. The frame 18 extends endwise outwardly from the second end 16 of the handle 12 and includes an outer portion 22 laterally offset to one side of the handle 12 and terminating in an end portion 24 projecting toward and extending outwardly beyond the other side of the handle 12. A paint roller of conventional design and designated by the reference numeral 26 is removably journaled on the end portion 24 in any conventional manner. Accordingly, the assembly 10, as far as hereinbefore specifically described, comprises a substantially conventional paint roller assembly.

However, the handle 12 includes a longitudinally extending water passage or conduit 28 formed therethrough and the passage or conduit 28 includes a first end 30 formed in the first end 14 of the handle 12 and provided with a diametrically enlarged threaded counterbore 32. The second end 34 of the conduit or passage 28 tapers in a direction transverse to the axis of rotation of the roller 26 and flares in a direction extending along the roller 26. Accordingly, it may be seen that water supplied to the first end 30 of the passage or conduit 28 under pressure will be discharged from the second end 34 in a fan-shaped discharge 36 disposed in a plane paralleling the axis of rotation of the roller 26 and containing a chord of the roller 26.

The handle 12, centrally intermediate its opposite ends, includes a threaded blind bore 38 opening laterally outwardly of the handle 12 in a direction transverse to the axis of rotation of the roller 26 and the threaded end of an elongated support rod 40 is threaded in the bore 38. The end of the rod 40 remote from the handle 12 is sharpened as at 42. Therefore, it may be appreciated that the rod 40 may be used as a ground spike and that the assembly 10 may thus be supported in elevated position above the ground with the sharpened end 42 of the rod 40 embedded in the ground.

With attention now invited more specifically to FIG. 4 of the drawings, the male end 44 of a conventional domestic garden hose 46 may be threaded into the counterbore 32 in order to communicate the passage or conduit 28 with a suitable source of water under pressure. Alternatively, the externally threaded end 48 of a conventional water pipe 50 may have the threaded and counterbored end of the passage or conduit 38 threaded thereonto in order to supply water under pressure to the passage or conduit 28.

With the assumption that the assembly 10 is to be utilized in conjunction with the ground spike, the first end 14 of the handle 12 may be threaded onto the male end 44 of a garden hose 46 and the sharpened end 42 of the rod 40 may be embedded in the ground in a manner to support the assembly 10 above the ground in an open yard location. Then, the inlet end of the hose 46 may be communicated with a domestic water supply whereby water will flow through the hose 46 and the passage or conduit 28 and be discharged from the flared end 34 thereof in the fan-shaped discharge 36 with the discharge 36 impacting with the roller 26 in a plane extending along a chord of the roller 26. Of course, as the discharge 36 of water impacts with the roller 26, the latter will be rapidly rotated on the end portion 24 and the water impacting with the outer nap of the roller 26 and diluting the paint residue thereon will be spun from the roller 26 by centrifugal force. Accordingly, substantially all paint residue on the roller 26 may be cleaned therefrom in a reasonably short period of time.

With the understanding that the roller 26 is rotated rapidly during the cleaning process by the jet discharge 36 of water impacting therewith, after the roller 26 has been cleaned, the supply of water under pressure to the passage or conduit 28 may be quickly terminated and the momentum of roller 26 will cause the latter to continue to rotate for a short period of time during which the water residue in the roller 26 will be spun, at least to a great extent, from the roller 26. Accordingly, the roller 26 will dry completely in a very short period of time.

From the foregoing description and FIGS. 1 and 2 of the drawings, it may be appreciated that the instant invention resides entirely within the provision of a handle which is only slightly modified over a conventional paint roller assembly handle. The handle is modified in that it is provided with the water passage or conduit 28 including the threaded counterbore 32, which counterbore may be provided with a removable washer, and also by the provision of the threaded blind bore 38 and the rod 42 removably, threadedly engageable in the bore 38. Thus, the improved structure of the instant invention may be readily incorporated into paint roller assemblies presently being manufactured. Further, the threaded counterbore 32 may be used to threadedly secure a male threaded end of an extension handle to the handle 12.

One of the most important aspects of the assembly 10 resides in its ability, when operatively connected to a conventional garden hose, to form and direct a strong fan-shaped jet of water onto the nap of the roller 26 along a path containing a short chord of the roller 26, whereby the roller 26 is caused to spin at high speed and the nap thereof is subjected to high frequency alternating water or other liquid dilution of the paint residue on the roller and extraction of the water or other liquid and paint residue from the roller by centrifugal force enabling the roller to be substantially fully cleaned of paint residue in less than one minute.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A paint roller assembly including an elongated handle having opposite end faces, an elongated frame having one base end portion anchored in one end of said handle with said frame projecting endwise outwardly from the corresponding end face of said handle and including a second free end portion disposed generally normal to the longitudinal axis of said handle, a paint roller journaled from said free end portion with a first plane generally normal to said roller and containing said longitudinal axis passing through said roller centrally intermediate its opposite ends, said frame, intermediate said base and free end portions including a laterally offset portion disposed to one side of the longitudinal axis of said handle extending between and rigidly interconnecting said base and free end portions, said handle having a substantially straight longitudinally extending water passage forward therethrough and opening endwise outwardly of the opposite end faces of said handle, the inlet end portion of said passage opening through the end face of said handle remote from said roller including coupling means for removably coupling the discharge end of a water supply conduit thereto, the outlet end portion of said passage opening outwardly of the end of said handle adjacent said roller tapering in the transverse dimension of said passage disposed transverse to the axis of rotation of said roller and increasing in the transverse dimension thereof normal to a second plane substantially normal to the first mentioned plane and intersecting with said roller along a short chord plane thereof, whereby the terminal end of said outlet end portion defines an elongated discharge slot for discharging a fan-shaped stream of water therefrom along said second plane, said roller assembly being entirely free of shroud structure even partially shrouding said roller, said coupling means comprising a threaded female coupling supported from said handle for removably threaded connection of a threaded male coupling on the discharge end of said water supply conduit to said handle in communication with said passage.

2. The combination of claim 1 wherein said handle, intermediate its opposite ends, includes a rod-type support removably supported therefrom and extending laterally outwardly from said handle in a direction disposed at generally right angles relative to the axis of rotation of said roller.

* * * * *